US005896818A

United States Patent [19]

Phillips

[11] Patent Number: 5,896,818

[45] Date of Patent: Apr. 27, 1999

[54] MODULAR PALLET TO ABSORB LIFTING FORCE

[76] Inventor: Stewart A. Phillips, 1288 Hunter Blvd., Booneville, Ind. 47601

[21] Appl. No.: 08/984,862

[22] Filed: Dec. 4, 1997

Related U.S. Application Data

[63] Continuation-in-part of application No. 08/699,248, Aug. 19, 1996, abandoned.

[51] Int. Cl.[6] ..... B65D 19/00

[52] U.S. Cl. ..... 108/51.11; 108/56.1

[58] Field of Search ..... 108/51.11, 56.1, 108/56.3, 55.1, 55.3, 55.5

[56] References Cited

U.S. PATENT DOCUMENTS

| | | | |
|---|---|---|---|
| 2,621,006 | 12/1952 | Norrefeldt et al. . | |
| 2,651,486 | 9/1953 | Woodward . | |
| 3,118,400 | 1/1964 | Kemp, Jr. et al. | 108/56.1 X |
| 3,572,261 | 3/1971 | Vasiliou | 108/56.1 |
| 4,112,854 | 9/1978 | Pitchford | 108/56.1 |
| 4,240,358 | 12/1980 | Munroe . | |
| 4,382,773 | 5/1983 | Rodgers | 108/55.3 X |
| 4,715,294 | 12/1987 | Depew . | |
| 4,732,528 | 3/1988 | Good | 108/55.1 X |
| 5,355,813 | 10/1994 | Darnell et al. | 108/55.3 |
| 5,402,735 | 4/1995 | DeJean . | |
| 5,417,167 | 5/1995 | Sadr . | |
| 5,487,343 | 1/1996 | Phillips . | |

FOREIGN PATENT DOCUMENTS

| | | | |
|---|---|---|---|
| 2430361 | 3/1980 | France | 108/56.1 |
| 129085 | 8/1950 | Sweden | 108/56.1 |

*Primary Examiner*—Jose V. Chen

*Attorney, Agent, or Firm*—Woodard, Emhardt, Naughton, Moriarty & McNett

[57] ABSTRACT

A pallet for absorbing fork lifting force. The pallet includes lengthwise extending stringers having opposite ends connected to end members. Cross members extend across the width of the pallet providing a supporting surface. Pin shaped fasteners extend horizontally through downwardly extending walls of the end members and into the opposite ends of the stringers. Lifting force applied to the end members is directed via the downwardly extending walls and across the horizontally extending fasteners in a vertical direction and then to the stringers eliminating any withdrawal force applied to the fasteners. The preferred embodiment includes outwardly bowed cross members to maximize pallet supporting surface in contact with coils supported thereatop.

10 Claims, 8 Drawing Sheets

MODULAR PALLET TO ABSORB LIFTING FORCE

REFERENCE TO RELATED APPLICATIONS

This application is a continuation-in-part of U.S. patent application Ser. No. 08/699,248, filed on Aug. 19, 1996 now abandoned by the same inventive entity, and entitled Modular Pallet to Absorb Lifting Force.

BACKGROUND OF THE INVENTION

1 . Field of the Invention

This invention is in the field of pallets and pallets upon which cargo may be stored and shipped.

2 . Description of the Prior Art

A variety of different types of pallets and pallets have been devised for storing and shipping cargo. An example of a prior art pallet is shown in the U.S. Pat. No. 4,715,294 issued to Depew. The pallets and pallets are commonly produced front wood although a variety of other materials have been used including plastic.

Wooden pallets frequently become damaged as a result of the forks of a forklift impacting the ends of the pallet runners. Further, the pallet runners develop cracks along growth lines as a result of the natural drying process. The lifting force applied by the forklift to the deck boards extending across and attached to the pallet runners results in the force being applied to the runners along the cracks. As a result, the pallet runners will split separating the deck boards from the runners. The damaged wooden pallets are scraped and assigned to the landfill due to the cost involved in repairing the damaged pallets. With the increased emphasis on minimizing landfills and with the further objective of increasing the durability of wooden pallets to allow extended life for reuse, I disclosed in my U.S. Pat. No. 5,487,343 a bracket mountable to the end of the runner securing the deck boards to the runners eliminating the aforementioned splitting and separation problem.

Many of the prior pallets include cross members mounted to the end of the pallet which extend across the width thereof. The cross members are fastened to the pallets by means of vertically extending nails, screws and other fasteners. As a result, when lifting force is applied to the lower surface of the cross member by a fork lift, the lifting force is directed through the vertically extending fasteners to the main body of the pallet resulting in the fasteners being forced upwardly and out of the pallet thereby separating the cross member and leading to the eventual destruction of the pallet. Disclosed herein is a new and improved pallet having the cross member secured to the main body of the pallet by means of horizontally extending fasteners. The lifting force applied to the lower surface of the cross member is thereby directed to the main body of the pallet via the fasteners in a perpendicular direction to the longitudinal axis of the fasteners. As a result, withdrawing force is not applied to the fasteners ensuring the integrity of the assembly.

The pallet disclosed herein is particularly useful in holding large metal coils each weighing 30,000 pounds or more. Further, as many as three coils may be stacked together placing 90,000 pounds on the pallet. The upwardly facing surface of the pallet immediately beneath the stack of coils receives the weight of the coils; however, the upwardly facing surface of the pallet normally located outward of the outside diameter of the coils serves no useful weight supporting function. In fact, that portion of the pallet located outwardly of the coil outside diameter is subject to damage and will bend and break as a result of the forks of a fork lift applying lifting force thereto. I have therefore designed a pallet conforming to the outside diameter of the coil eliminating that portion of the pallet normally located outwardly thereof. A pallet is therefore provided which is more damage proof and also provides cost savings as a result of the smaller size of the pallet. The cost savings has further been maximized by eliminating that portion of the upwardly facing pallet surface normally located beneath the hollow center of the coil since such surface does not provide any weight supporting function.

The modular pallet for supporting the coils incorporates the previously discussed structure of fastening the cross members to the main body of the pallet via horizontally extending fasteners. Thus, in the event excessive lifting force is applied to the pallet, then the fasteners located below the top of the pallet will shear with new fasteners then being readily installed. Another advantage is the prevention of damage to any object resting atop the pallet such as might occur if any vertically extending nail or screw were worked out of the pallet by the lifting force. In order to minimize the cost of a pallet repair, the pallet is modular in construction with the cross members having the same shape and configuration.

SUMMARY OF THE INVENTION

One embodiment of the present invention is a modular pallet including a plurality of elongated members and a plurality of deck members extending across and attached atop and to the elongated members. A pair of deck members are attached at the opposite ends of elongated members extending outwardly of the opposite ends of the elongated members protecting the ends from fork lift damage. A plurality of fasteners connect the deck members to the elongated members with lifting force applied to the deck members directed to the elongated members across the cross sectional area of the fasteners. In the preferred embodiment the deck members are bowed outwardly to maximize contact area between the pallet and a coil supported thereatop while minimizing non-contact deck member area.

It is an object of the present invention to provide a new and improved pallet.

It is an object of the present invention to provide a pallet for maximizing contact area between the pallet and an object supported thereatop while minimizing that portion of the pallet extending outwardly of the supported object.

A further object of the present invention is to provide a pallet to absorb lifting force from a lifting fork without any force being directed to separate pallet components.

In addition, it is an object of the present invention to provide a pallet having end caps to surround and protect the opposite ends of the pallet main body.

Related objects and advantages of the present invention will be apparent from the following description.

DESCRIPTION OF THE PREFERRED EMBODIMENTS

Figure 1:
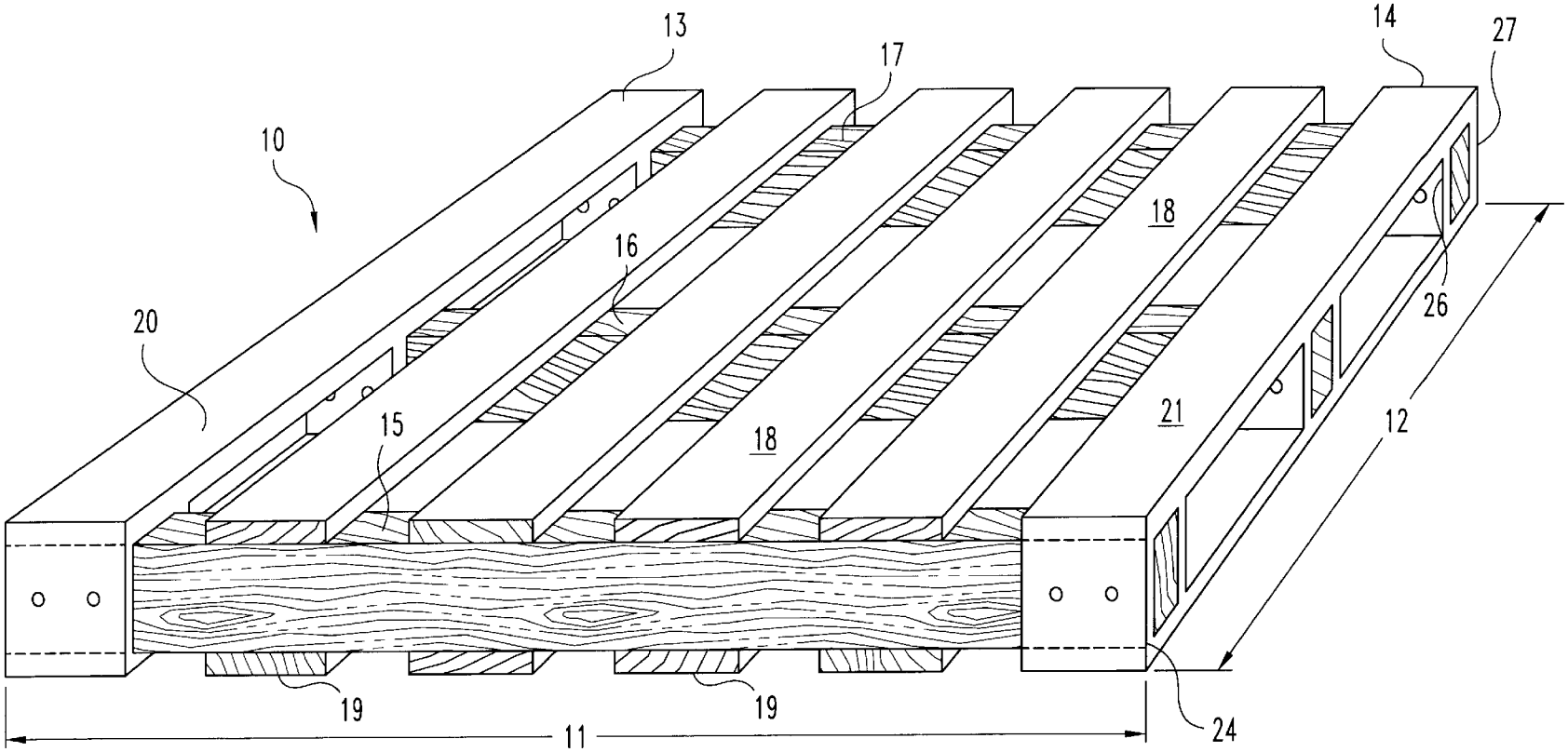
FIG. 1 is a perspective view of the second alternate embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more specifically to FIG. 1, the second alternate embodiment of the pallet 10 having length 11 and width 12 with opposite ends 13 and 14. The main body of the pallet is composed of a plurality of parallel stringers or elongated members 15, 16, and 17 extending in the direction of length 11 which are attached to a plurality of top cross members 18 and bottom cross members 19. Members 18 and 19 are board shaped and are parallel with each other extending across the width 12 of the pallet. Cross members 18 are positioned atop and attached directly to stringers 15–17 whereas bottom cross members 19 are positioned beneath and attached to the same stringers. The top cross members 18 provide an upper supporting surface for items to rest atop the pallet.

Figure 5:
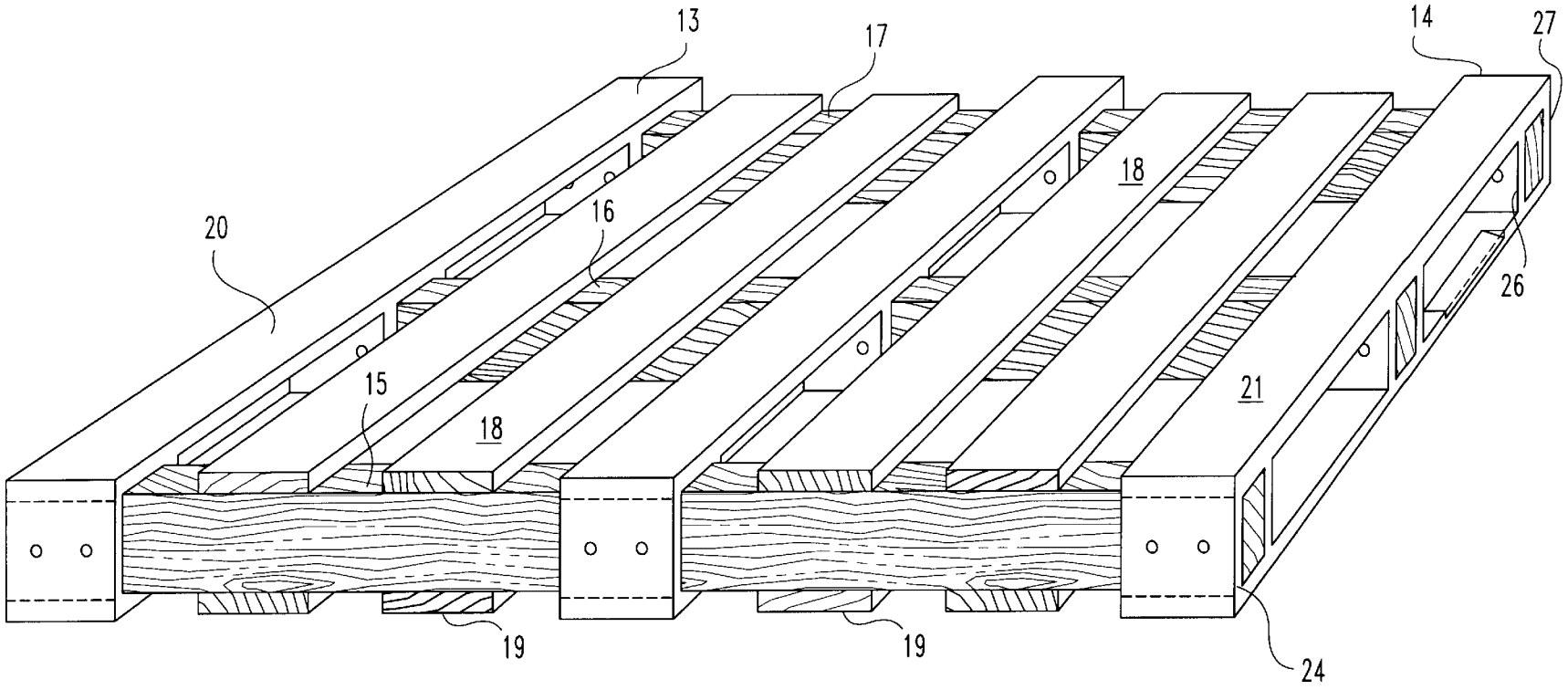
FIG. 5 is the same view as FIG. 1 only showing the pallet with an intermediate member.

The main body of the pallet further includes a plurality of end members or cap members which are attached to the stringers 15–17. In the embodiment shown in FIG. 1, a pair of end members 20 and 21 are attached to the opposite ends of stringers 15–17 although end members 20 and 21 are designed to also be positioned intermediate the ends of the pallet with one such intermediate end member 43 shown in FIG. 5. That is, intermediate end member 43 is identical in configuration and size to end members 20 and 21 and may be located between end members 20 and 21 being attached to members 15, 16, and 17 in the manner identical to the attachment of end members 20 and 21 to members 15, 16, and 17. Further, additional intermediate members may be located along the length of the pallet between end members 20 and 21. Likewise, the pallet shown in FIG. 1 includes three such stringers 15–17 although a pallet may have more or less than three such stringers. The pallet is modular in construction in that the number of stringers 15–17, top cross members 18, bottom cross members 19 and end members 20 and 21 may be varied depending upon the size of the pallet desired and the weight of the items to be positioned there atop.

Figure 2:
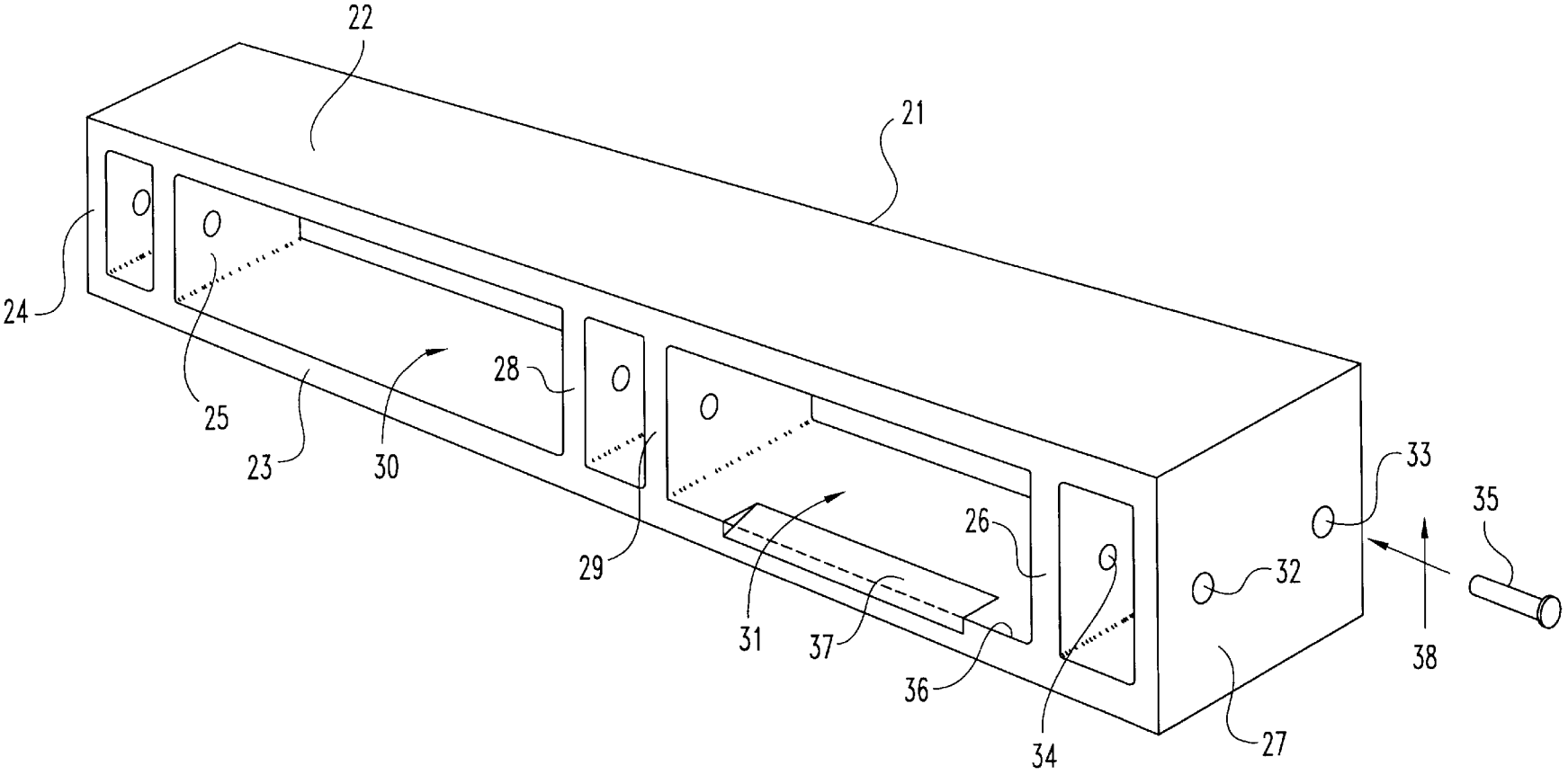
FIG. 2 is a perspective view of one of the end members included in the pallet of FIG. 1.
Figure 3:
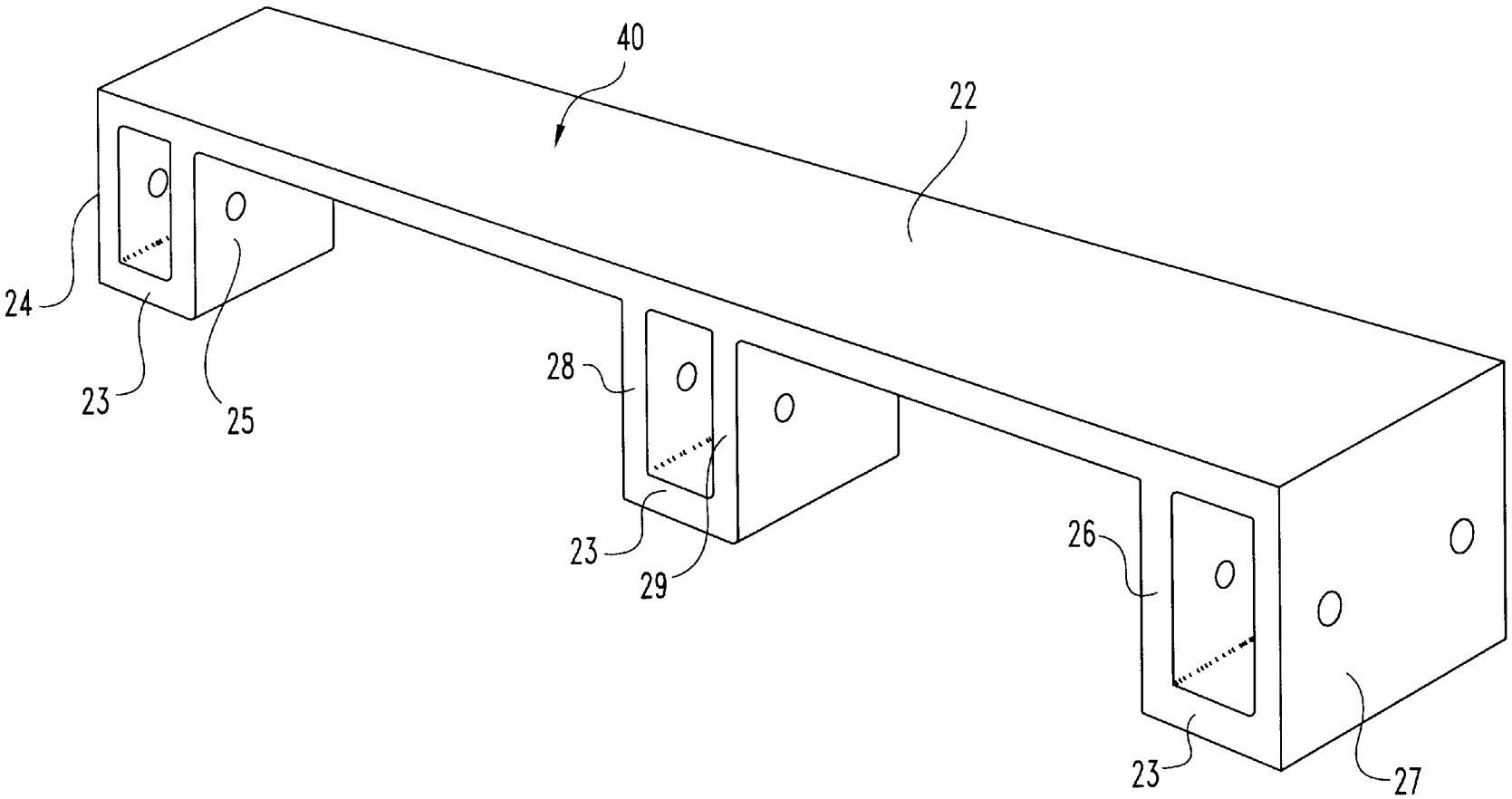
FIG. 3 is a perspective view of an alternate design of the end member.
Figure 4:
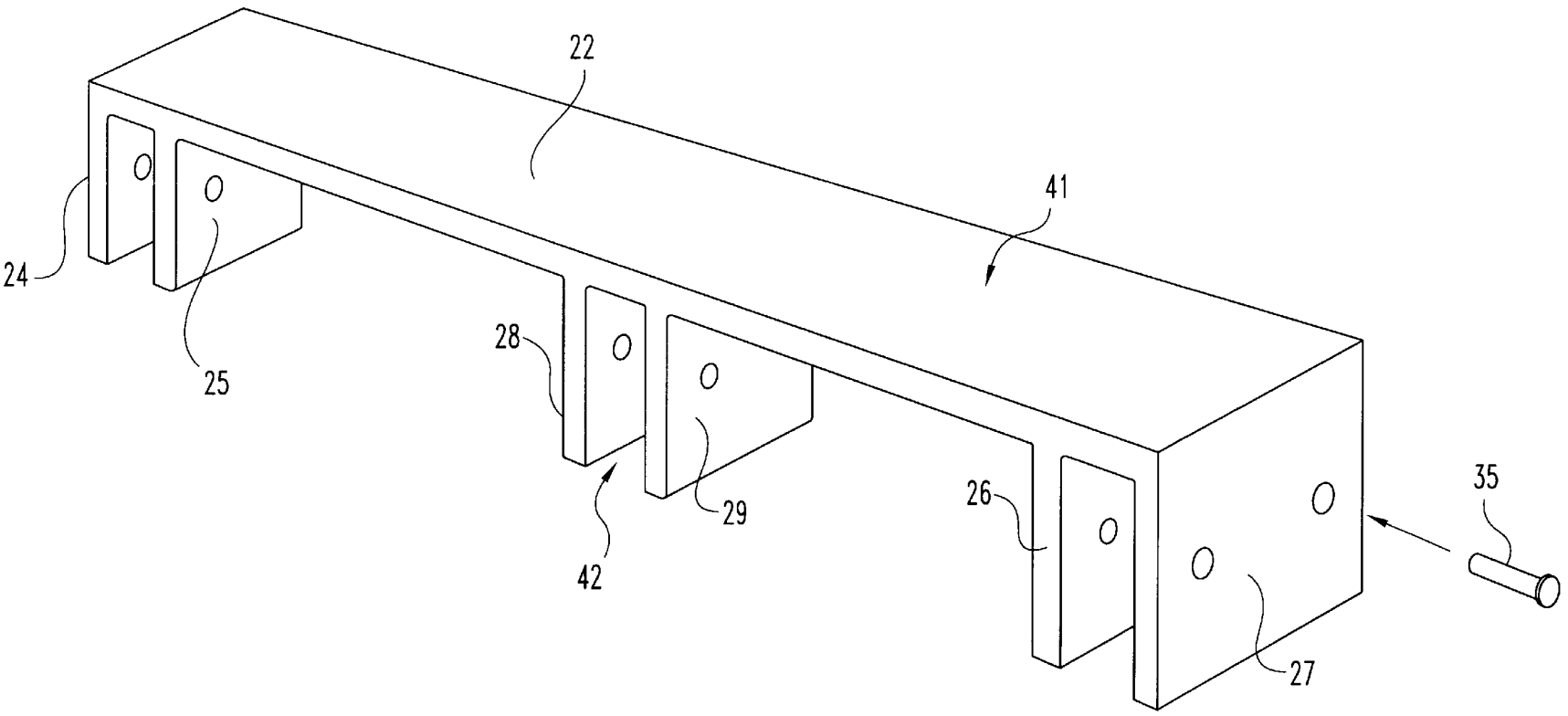
FIG. 4 is a perspective view of yet a further alternate design of the end member.

Three different designs for the end members are shown in FIGS. 2–4 with the design of FIG. 2 being included in the pallet of FIG. 1. End member 21 will be described it being understood that an identical description applies to end member 20. End member 21 includes a pair of horizontally extending and parallel walls 22 and 23 (FIG. 2) spaced apart but joined together by a plurality of downwardly extending walls. Three such pairs of the downwardly extending walls are included in end member 21. That is, parallel walls 24 and 25 are integrally joined to the adjacent ends of walls 22 and 23 forming a first pair whereas the second pair of downwardly extending walls is composed of walls 26 and 27 integrally joined to the spaced apart opposite ends of walls 22 and 23. A third pair of downwardly extending walls 28 and 29 are integrally joined to walls 22 and 23 and are positioned intermediate the opposite ends of the horizontally extending walls.

A pair of fork lift openings 30 and 31 are provided to receive the outwardly extending forks of a fork lift for raising and lowering of the pallet. Opening 30 is formed by walls 22, 23, 25 and 28 whereas opening 31 is formed by walls 22, 23, 26 and 29.

Walls 24 and 25 are spaced apart to receive the end of stringer 15. Likewise, walls 28 and 29 are spaced apart to receive the end of stringer 16 whereas walls 26 and 27 are spaced apart to receive the end of stringer 17. The downwardly extending walls in each pair are parallel and are further parallel to the vertically extending surfaces of the stringers.

Each of the walls 24–29 have a pair of holes to receive standard fastening devices extending through the walls and the stringers positioned therebetween. The holes in each pair of walls are aligned allowing the fastener to extend through a pair of walls along with the associated stringer. For example, wall 27 includes holes 32 and 33. Wall 26 also includes a pair of holes aligned with holes 32 and 33. One such hole 34 is shown in FIG. 2 as aligned with hole 32. A separate fastener 35 extends through holes 32 and 34. Likewise, a separate fastener 35 extends through hole 33 and the hole in wall 26 aligned with hole 33. Thus, a total of six fasteners 35 secure walls 24–29 to the stringers with two such fasteners associated with each pair of downwardly extending walls and stringer end.

Fasteners 35 are pin shaped and may take the form of a threaded bolt, a smooth pin, or similar device. Fasteners 35 extend perpendicularly through walls 24–29 and also perpendicularly through stringers 15–17. That is, the longitudinal axis of pin 35 is perpendicularly arranged for example relative to walls 26 and 27 and the end of stringer 17. In one embodiment, fastener 35 extends through the holes in walls 26 and 27 and is pressed fitted into stringer 27.

In order to lift pallet 10, the forks of a fork lift are extended into openings 30 and 31 contacting the downwardly facing surface of wall 22. The outer top edge 36 of wall 23 may be beveled providing an upwardly sloping surface 37 (FIG. 2) in order to guide the fork into the opening. Only one such bevel is shown for opening 31; however, it is to be understood that a similar bevel may or may not be provided for opening 30.

As the fork lift is moved upwardly, lifting force is applied to wall 22. This same vertical lifting force is applied directly to downwardly extending walls 24–29 since walls 24–29 are integrally attached to wall 22. The upwardly directed lifting force from walls 24–29 is then transmitted to the ends of stringers 15–17 by means of fasteners 35. Since fasteners 35 and their longitudinal axis extend horizontally, the upwardly directed lifting force is applied across the width wise extending cross sectional areas of the shanks of the fasteners in the upward direction of arrow 38 (FIG. 2). Thus, the lifting force is applied in a shearing direction 38 across the shanks of the fasteners although it is to be understood that the shanks actually do not shear. The same force is then transmitted via the shanks of the fasteners directly to the stringer. Since the fastener extends completely through a pair of downwardly extending walls and the associated stringer, the fastener continues to extend horizontally insuring the lifting force is applied to the fastener in a shearing direction as compared to a withdrawal direction along the longitudinal axis of the fastener. For example, fastener 35 extends completely through walls 26 and 27 and the end of stringer 17. Thus, the lifting force does not act to cause fastener 35 to pull out or withdraw from walls 26 and 27 and stringer 17.

End members or cap members 20 and 21 extend outwardly both above and below the stringer ends and in a sideways direction relative to the ends to protect the ends from fork lift damage. For example, parallel walls 22 and 23 (FIG. 2) extend outwardly both above and below the ends of the stringers whereas walls 26 and 27 extend outwardly in a sideways direction relative to stringer 17. End members 20 and 21 may be produced from a variety of materials including plastic. Likewise, stringers 15–17 and cross members 18 and 19 may be produced from a variety of materials including wood or plastic. Walls 24–29 are perpendicularly arranged relative to walls 22 and 23 thereby providing rectangular openings for receiving the stringer ends as well as for receiving the forks in openings 30 and 31. End members 20 and 21 along with cross members 18 and 19 extend across the width 12 of the pallet whereas the stringers extend in the direction of the length of the pallet.

Variations of the design of the end members are shown in FIGS. 3 and 4. End member 40 is identical to end member 21 having the downwardly extending walls 24–29 except that bottom wall 23 does not extend between pairs of the downwardly walls. For example, wall 23 is perpendicularly arranged and integrally connected to the bottom ends of walls 24 and 25 but does not extend between walls 25 and 28. End member 41 (FIG. 4) is a further design of the end member and is identical to end member 21 except the end member does not include a bottom wall 23. Thus, the downwardly extending walls 24–29 are integral with and perpendicularly arranged to wall 22 with the lower ends of walls 24–29 being free and unattached. Thus, the pairs of walls of end member 41 form inverted U-shaped recesses to facilitate the mounting of end member 41 to the stringers. For example, recess 42 formed between walls 28 and 29 receive an end of stringer 16. When assembling the end members to the stringers, end member 41 may be slipped atop and onto the stringers. Both end members 40 and 41 include aligned holes in the downwardly extending walls to receive the fasteners in the identical manner previously described for end member 21. Thus, end members 40 and 41 distribute the lifting force in the same manner as that described for end member 21.

Generally, in the event end member 41 is to be utilized in the pallet, then the pallet is provided with stringers and top cross members 18; however, bottom cross members 19 are not utilized. In the case of end members 21 and 40, the downwardly extending walls along with walls 22 and 23 extend completely around or in other words 360° around the end of the stringer.

Figure 6:
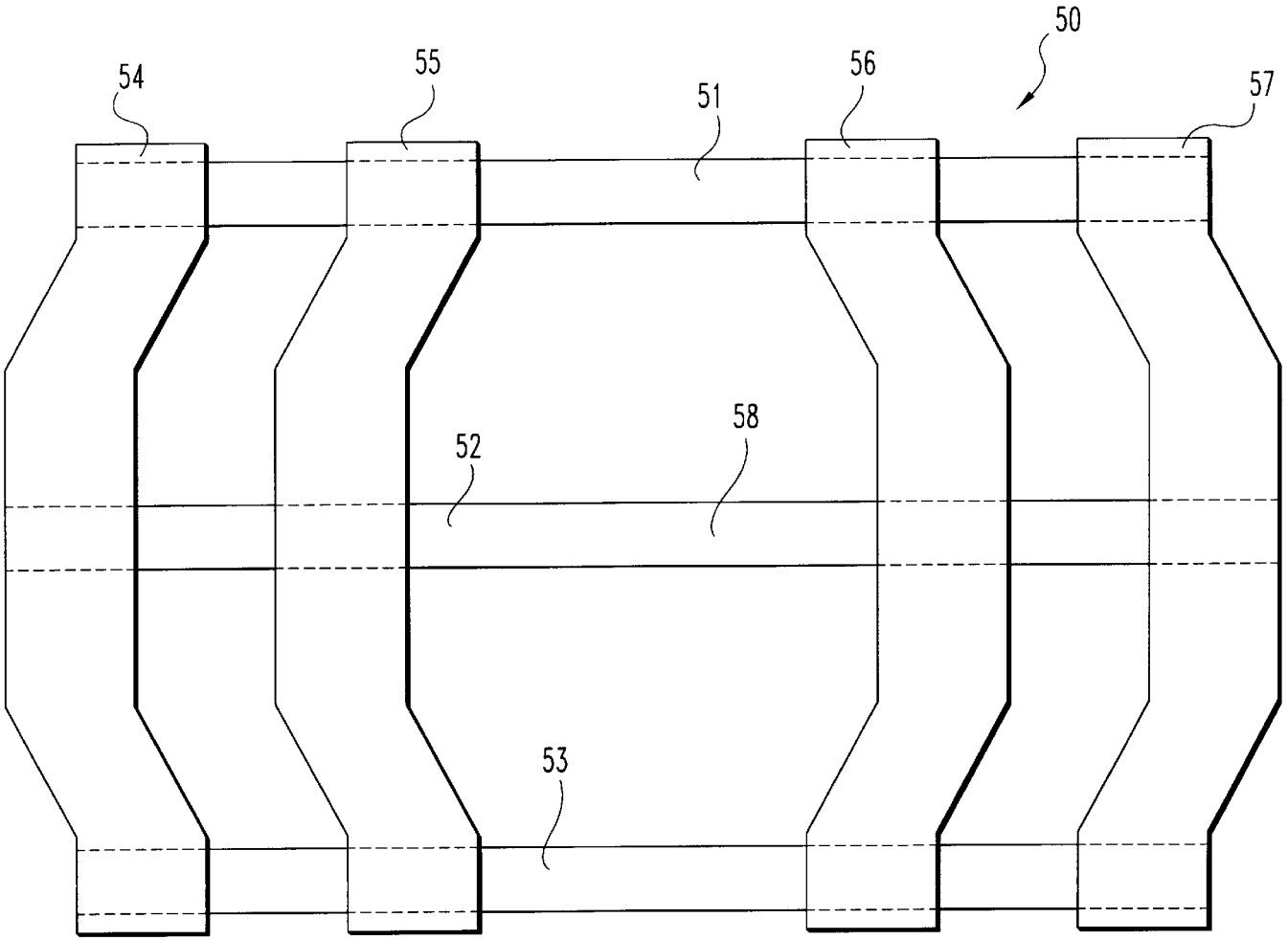
FIG. 6 is a top view of the preferred embodiment of the pallet.

The preferred embodiment of the pallet is shown in FIG. 6. Pallet 50 includes three runners 51, 52, and 53 removably fastened to four cross members or deck components 54, 55, 56, and 57. The number of deck components as well as the number of runners may vary depending upon the objects to be supported atop the pallet. Deck components 54–57 are identical with two of the deck components 54 and 55 being arranged to bow outwardly to the left of the mid point 58 of runner 52 and with the two remaining deck components 56 and 57 being arranged to bow outwardly to the right of mid point 58.

Figure 7:
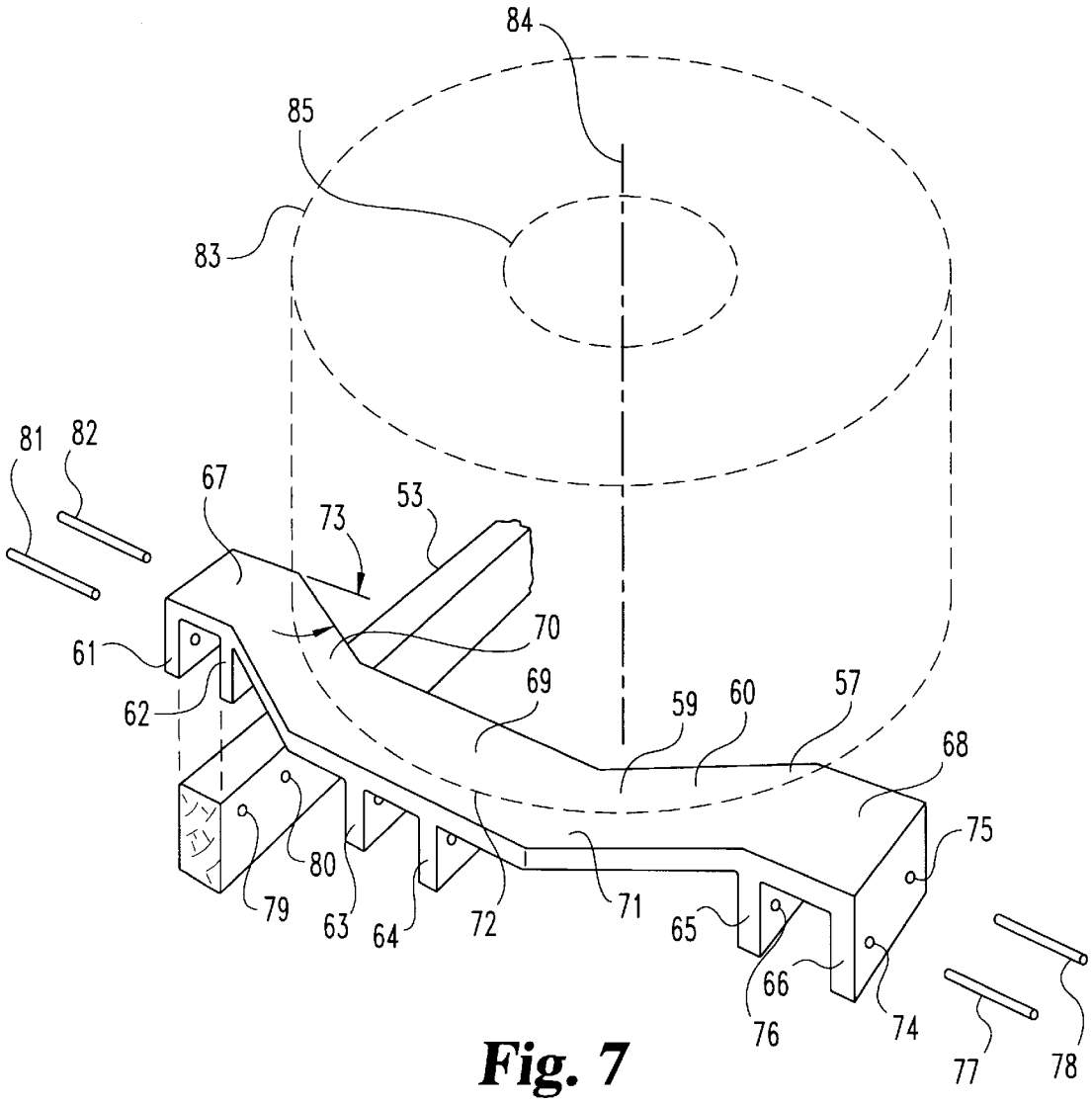
FIG. 7 is a fragmentary perspective view depicting the assembly of a deck component to a runner.

Deck component 57 (FIG. 7) will now be described it being understood that an identical description applies to deck components 54, 55, and 56. Component 57 has a top wall 59 with an upwardly facing supporting surface 60. Three pairs of downwardly extending flanges receive runners 51–53. That is, flanges 61 and 62 are spaced apart to fit on the opposite sides of runner 53 whereas flanges 63, 64, and flanges 65, 66 are spaced apart to fit on the opposite sides respectively of runners 52 and 51. The flanges and top wall 59 form openings between the runners to receive lifting forks in the manner as described for the pallet of FIG. 1. Flanges 61–66 are integrally connected to top wall 59 and may be produced from a plastic material whereas the runners may be produced from plastic or wood. Top wall 59 is designed to fit complimentary beneath a cylindrical shaped coil 83 resting thereatop with the longitudinally central coil axis 84 extending vertically through the coil hollow center 85. Thus, the top wall 59 includes a pair of opposite and outwardly located wall portions 67 and 68 which extend perpendicularly across respectively runners 53 and 51 with an intermediate wall portion 69 extending perpendicularly across runner 52. Intermediate wall portion 69 is integrally joined to wall portions 67 and 68 respectively by angular wall portions 70 and 71. As a result, flanges 63 and 64 are offset along the longitudinally axis of the runners relative to flanges 61, 62, 65, and 66. In the event a cylindrical shaped coil is positioned atop pallet 50 with the longitudinal central axis of the coil extending vertically through mid point 58, then the coil will be supported and rest atop both the angular shaped portions 70 and 71 as well as the intermediate portion 69 depending upon the outside diameter of the coil. For example, dashed line 72 (FIG. 7) represents the outside diameter of the coil 83 with the coil resting atop not only the angular portions 70, 71 and the intermediate portion 69 but also the outwardly located portions 67 and 68. Both the length and width of the pallet as well as the angle 73 between the angular portions and the outwardly located wall portions may be varied depending upon the size of the coils resting thereatop to maximize the pallet supporting surface for the coil.

The deck components are positioned on the runners along the length of the pallet so as to contact at least some portion of coil 83 resting thereatop. That is, the number of deck components are selected and positioned along the length of the runners to contact coil 83. Thus, deck components 54 and 57 (FIG. 6) contact the outside diameter portion of the coil whereas intermediate deck components 55 and 56 contact the portion of the coil located adjacent to the inside coil diameter surrounding the hollow center. No deck components are located so far outwardly of the coil so as to not contact the coil. Thus, the upwardly facing surfaces 60 (FIG. 7) of the deck components are located along the length of the pallet to maximize contact with the coil located atop the pallet while minimizing the amount of the upwardly supporting surface 60 located outwardly of the outside diameter of said coil. Likewise, since the middle portion of the deck components located to the left of the midpoint are offset in an opposite direction than the middle portion of the deck components located to the right of the midpoint the amount of the upwardly supporting surface 60 is minimized beneath the hollow center 85 of the coil.

Each flange 61–66 include a pair of holes through which horizontally extending fastening devices extend securing the deck components to the runners. For example, flange 66 includes a pair of holes 74 and 75 aligned with a pair of holes in flange 65. One such hole 76 is shown and is aligned with hole 74 it being understood that a second hole is provided in flange 65 and is aligned with hole 75. Likewise, runners 51–53 are provided with horizontally extending holes aligned with the holes extending through the flanges. Two such holes 79 and 80 are shown in runner 53 being aligned with holes extending through flanges 61 and 62. Thus, pins 81 and 82 extend through the two holes in flange 61, holes 79 and 80 of runner 53 and then through the two holes in flange 62. Likewise, a pair of pins 77 and 78 extend through flanges 65 and 66 and runner 51. A third set of pins extend through runner 52 and flanges 63 and 64. Thus, as lifting force is applied to the downwardly facing surface of deck component 57, the force is directed through flanges 61–66 and perpendicularly in a shearing direction across the pins fastening the deck component to the runners. In the event the lifting force is excessive, then the pins will shear preventing damage to the runners and cross member. Deck components 54–56 are attached to runners 51–53 in the same manner as for deck component 57.

Figure 8:
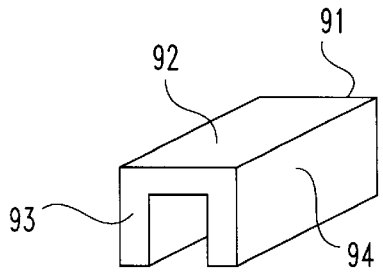
FIG. 8 is a perspective view of a filler block.
Figure 9:
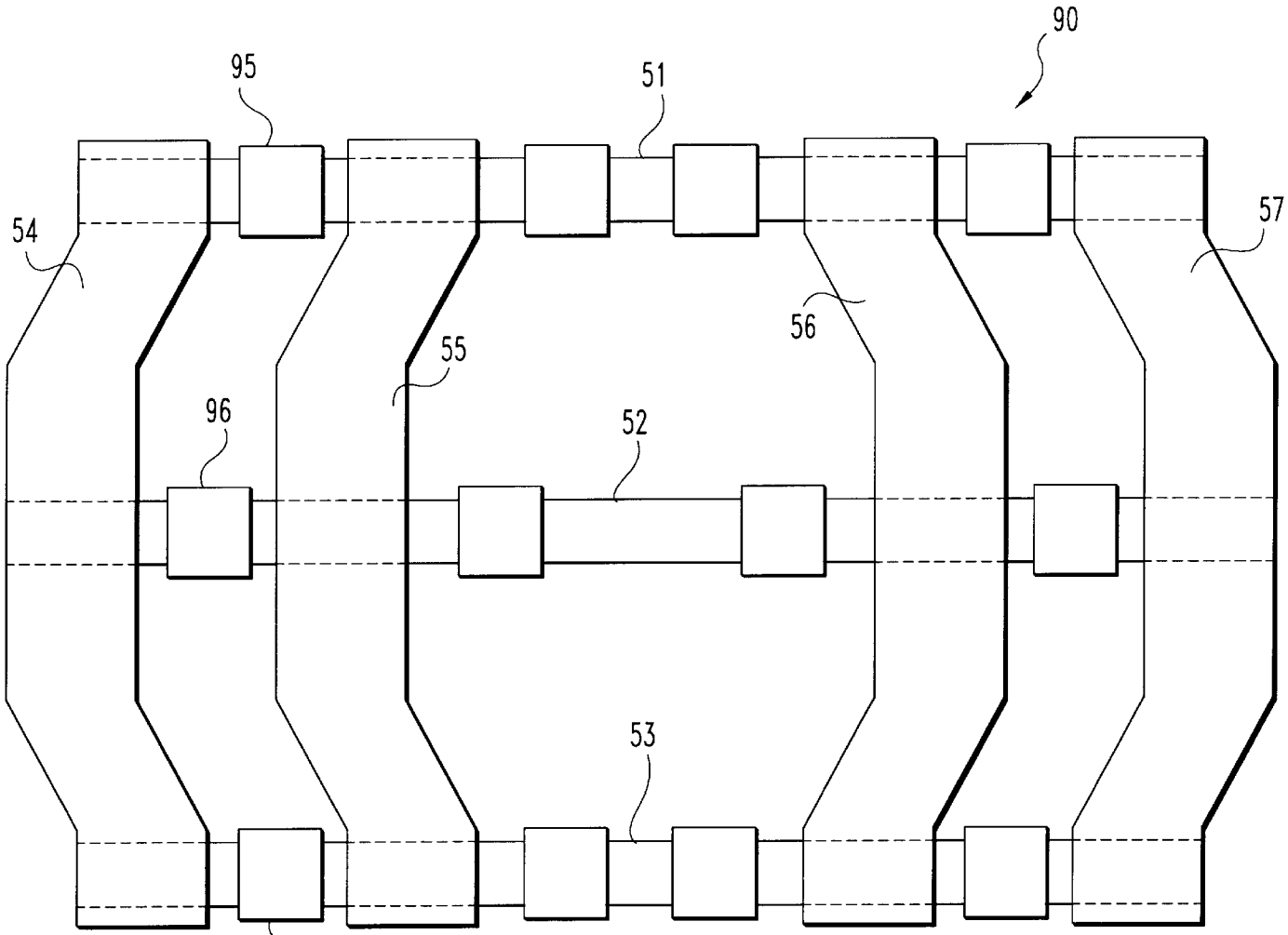
FIG. 9 is the same view as FIG. 6 only showing the first alternate embodiment of the pallet having the filler block of FIG. 8 mounted thereto.

The first alternate embodiment of pallet 50 is shown in FIG. 9. Pallet 90 is identical to pallet 50 with the exception that a plurality of filler blocks are mounted to the runners between the cross member. One such filler block is shown in FIG. 8. Filler block 91 includes a top wall 92 integrally joined to a pair of downwardly extending walls 93 and 94. The purpose of the filler block is to reduce the pounds per square inch at points of load by increasing the contact area between the pallet and the object resting thereatop. The filler blocks may be nailed, stapled or friction fitted to the runners. In the embodiment shown in FIG. 9, three filler blocks 95, 96 and 97 are located on runners 51–53 between deck components 54 and 55. The downwardly extending walls 93 and 94 of each filler block are spaced apart to fit adjacent the opposite sides of the runners. Thus, walls 93 and 94 of filler block 95 fit adjacent the opposite sides of runner 51 with the top wall 92 of filler block 95 resting atop runner 51. Likewise, three separate filler blocks are mounted to runners 51–53 between deck components 56 and 57. Due to the spacing apart of the oppositely bowed deck components 55 and 56. Two filler blocks are mounted to runner 51 between deck components 55 and 56. Likewise, two filler blocks are mounted to runner 52 and also to runner 53 between deck components 55 and 56.

While the invention has been illustrated and described in detail in the drawings and foregoing description, the same is to be considered as illustrative and not restrictive in character, it being understood that only the preferred embodiments has been shown and described and that all changes and modifications that come within the spirit of the invention are desired to be protected.

What is claimed is:

1. A modular pallet comprising:

a plurality of elongated members having a solid rectangular cross section with an upwardly facing surface, said members extending lengthwise parallel to each other each having opposite ends;

a plurality of board shaped members extending across and attached atop and to said upwardly facing surface of said elongated members to support items resting atop the pallet;

a pair of plastic cap members attached at said opposite ends of said elongated member, said cap members extending outwardly above, below and sideways relative to said opposite ends protecting said ends from fork lift damage, said cap members each including a first horizontally extending top wall and first pairs of downwardly extending extensions integrally connected together with said pairs of extensions positioned on opposite sides of and adjacent each of said elongated members;

a plastic intermediate member attached to said elongated members intermediate said opposite ends, said intermediate member extending outwardly above, below and sideways relative to said elongated members, said intermediate member including a second horizontally extending top wall and second pairs of downwardly extending extensions with said second pairs of extensions positioned on opposite sides of and adjacent each of said elongated members; and, a plurality of fasteners connecting said cap members to said elongated members, each fastener extending horizontally though both extensions and elongated member positioned therebetween, said fasteners have opposite end portions positioned in said first pairs of downwardly extending extensions and said second pairs of downwardly extending extensions, said fasteners extend perpendicularly through said elongated members allowing lifting force applied to said first horizontally extending top wall and directed through said first pairs of downwardly extending extensions in a shearing direction across and to said opposite end portions, said fasteners extend through said elongated members and said intermediate member and outwardly into each of said first pairs of downwardly extending extensions and said second pairs of downwardly extending extensions.

2. The pallet of claim 1 wherein:

said fasteners are pin shaped and are press fitted into said elongated members directing lifting force from said cap members to said elongated member in a shearing direction across said fasteners.

3. The pallet of claim 1 wherein:

said fasteners extend perpendicular through said extensions and said elongated members.

4. A pallet having length and width and opposite ends comprising:

a plurality of stringers having a solid rectangular cross section with an upwardly facing surface extending in the direction of the length of the pallet;

a plurality of cross members attached to said stringers atop said upwardly facing surface and extending in the direction of the width of the pallet forming an upper supporting surface for items to rest atop the pallet;

a plurality of end members attached to said stringers, said end members extending in the direction of the width of the pallet and positioned at the opposite ends of the pallet, said end members including lifting fork receiving openings having horizontally extending walls to receive lifting force from lifting forks inserted into said openings, said end members further including downwardly extending walls connected to said horizontally extending walls to receive said lifting force and forming channels into which said stringers extend; and, fastening means with widthwise extending cross sectional areas with said means connecting said downwardly extending walls to said stringers to direct said lifting force from said downwardly extending walls in an upward direction across said cross sectional areas of said fastening means into said stringers; and wherein:

said fastening means are elongated shaped fasteners extending lengthwise in a horizontal direction perpendicular into said downwardly extending walls and said stringers with said lifting force applied from said downwardly extending walls to said stringers in a shearing direction across said fasteners, said downwardly extending walls are arranged in pairs of spaced apart walls between which said channels with said stringers are positioned, said fasteners extend across said channels through said stringers and outwardly into each of said spaced apart walls of said end members, each fastener extending across a channel has opposite end portions positioned in a pair of said spaced apart walls allowing lifting force applied to said horizontally extending walls and directed through said pair of spaced apart walls in a shearing upward direction to said opposite end portions of said fasteners.

5. A modular pallet comprising:

a plurality of elongated members having a solid rectangular cross section with an upwardly facing surface, said members extending lengthwise parallel to each other each having opposite ends;

a pair of plastic cap members attached at each opposite ends of said elongated members, said cap members extending outwardly above and sideways relative to said opposite ends protecting said ends from fork lift damage, said cap members each including a first horizontally extending top wall and first pairs of downwardly extending extensions integrally connected together with said pairs of extensions positioned on opposite sides of and adjacent each of said elongated members;

a plastic intermediate member attached to said elongated members intermediate said opposite ends, said intermediate member extending outwardly above and sideways relative to said elongated members, said intermediate member including a second horizontally extending top wall and second pairs of downwardly extending extensions with said second pairs of extensions positioned on opposite sides of and adjacent each of said elongated members; and, a plurality of fasteners connecting said cap members to said elongated members, each fastener extending horizontally through both extensions and elongated member positioned therebetween, said fasteners have opposite end portions positioned in said first pairs of downwardly extending extensions and said second pairs of downwardly extending extensions, said fasteners extend perpendicularly through said elongated members allowing lifting force applied to said first horizontally extending top wall and directed through said first pairs of downwardly extending extensions in a shearing direction across and to said opposite end portions, said fasteners extend through said elongated members and said intermediate member and outwardly into each of said first pairs of downwardly extending extensions and said second pairs of downwardly extending extensions.

6. A pallet having length and width and opposite ends for supporting thereatop a coil having an outside diameter with a hollow center and a longitudinally extending central coil axis comprising:

a plurality of runners extending in the direction of the length of the pallet;

a plurality of deck components attached to said runners and extending in the direction of the width of the pallet forming an upper supporting surface for items to rest atop the pallet, said deck components are identical in configuration and size and are located both at the opposite ends of said pallet and intermediate and between thereof, said deck components including lifting fork receiving openings having horizontally extending walls to receive lifting force from lifting forks inserted into said openings, said deck components further including downwardly extending flanges connected to said horizontally extending walls to receive said lifting force and forming channels into which said runners extend; and, fastening means with widthwise extending cross sectional areas with said means connecting said downwardly extending flanges to said runners to direct said lifting force from said downwardly extending flanges in an upward direction across said cross sectional areas of said fastening means into said runners; and wherein:

said fastening means include elongated shaped fasteners extending lengthwise in a horizontal direction perpendicular into said downwardly extending flanges and said runners with said lifting force applied from said downwardly extending flanges to said runners in a shearing direction across said fasteners, said downwardly extending flanges are arranged in pairs of spaced apart walls between which said channels with said runners are positioned, said fasteners extend across said channels through said runners and into each of said spaced apart walls, one of said runners has a midpoint with deck components located to the right of said midpoint bowing outwardly in a first direction and deck components located to the left of said midpoint bowing outwardly in a direction opposite to said first direction.

7. The pallet of claim 6 wherein:

said deck components are positioned on said runners along the length of said pallet to receive at least some portion of a coil positionable thereatop.

8. The pallet of claim 1 wherein:

said deck components have opposite end portions and a middle portion integrally joined together forming an upwardly supporting surface, said middle portion offset along the length of said pallet relative to said opposite end portions.

9. The pallet of claim 8 wherein:

said middle portion of said deck components located to the left of said midpoint are offset in an opposite direction than said middle portion of deck components located to the right of said midpoint.

10. The combination of:

a coil having an outside diameter with a center and a longitudinally extending central coil axis extending through said center;

a pallet having length and width and opposite ends supporting said coil thereatop, said pallet having a plurality of runners extending in the direction of the length of the pallet and a plurality of deck components attached to said runners and extending in the direction of the width of the pallet forming an upper supporting surface to support said coil;

fasteners with widthwise extending cross sectional areas with said fasteners connecting said deck components and said runners together; and wherein:

one of said runners has a midpoint with a deck component located to the right of said midpoint bowing outwardly in a first direction and a deck component located to the left of said midpoint bowing outwardly in a second direction opposite to said first direction;

said deck components including lifting fork receiving openings having horizontally extending walls to receive lifting force from lifting forks inserted into said openings, said deck components further including downwardly extending flanges connected to said horizontally extending walls to receive said lifting force and forming channels into which said runners extend, said deck components further including opposite end portions and a middle portion integrally joined together forming an upwardly supporting surface, said middle portion offset along the length of said pallet relative to said opposite end portions maximizing contact between said upwardly supporting surface and said coil located thereatop while minimizing location of said upwardly supporting surface outwardly of the outside diameter of said coil; and, said fasteners connecting said downwardly extending flanges to said runners to direct said lifting force from said downwardly extending flanges in an upwardly direction across said cross sectional areas of said fasteners into said runners, said fasteners are elongated extending lengthwise in a horizontal direction perpendicular into said downwardly extending flanges and said runners with said lifting force applied from said downwardly extending flanges to said runners in a shearing direction across said fasteners, said downwardly extending flanges are arranged in pairs of spaced apart walls between which said channels with said runners are positioned, said fasteners extend across said channels through said runners and into each of said spaced apart walls.

* * * * *